US008350774B2

(12) United States Patent
Pickles

(10) Patent No.: US 8,350,774 B2
(45) Date of Patent: Jan. 8, 2013

(54) DOUBLE BALUN DIPOLE

(75) Inventor: William R. Pickles, Vienna, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 410 days.

(21) Appl. No.: 12/209,932

(22) Filed: Sep. 12, 2008

(65) Prior Publication Data

US 2010/0271280 A1 Oct. 28, 2010

Related U.S. Application Data

(60) Provisional application No. 60/972,422, filed on Sep. 14, 2007.

(51) Int. Cl.
*H01Q 9/28* (2006.01)

(52) U.S. Cl. ..... 343/795; 343/821; 343/859

(58) Field of Classification Search ..... 343/700 MS, 343/702, 858, 859, 795, 820, 821
See application file for complete search history.

(56) References Cited

U.S. PATENT DOCUMENTS

| | | | | |
|---|---|---|---|---|
| 4,063,245 | A * | 12/1977 | James et al. | 343/700 MS |
| 4,825,220 | A | 4/1989 | Edward et al. | |
| 5,081,466 | A * | 1/1992 | Bitter, Jr. | 343/767 |
| 5,274,391 | A * | 12/1993 | Connolly | 343/820 |
| 6,008,773 | A * | 12/1999 | Matsuoka et al. | 343/818 |
| 6,483,464 | B2 | 11/2002 | Rawnick et al. | |
| 6,512,487 | B1 | 1/2003 | Taylor et al. | |
| 7,639,198 | B2 * | 12/2009 | Timofeev et al. | 343/805 |
| 7,750,851 | B2 * | 7/2010 | Washiro | 343/700 MS |

OTHER PUBLICATIONS

M. Kragalott, W.R. Pickles, and M.S. Kluskens, "Design of a 5:1 bandwidth stripline notch array from FDTD analysis," IEEE Trans. Antennas Propagat., vol. 48, pp. 1733-1741, (Nov. 2000).

* cited by examiner

*Primary Examiner* — Tan Ho
(74) *Attorney, Agent, or Firm* — Amy L. Ressing; L. George Legg

(57) ABSTRACT

A double balun dipole antenna element includes a dielectric substrate having a first surface and an opposing second surface, a pair of coplanar Marchand baluns positioned in a mutually antiphase configuration on the first and second surfaces, and at least one feed line connected to the pair of Marchand baluns. A doubly polarized antenna element includes a pair of orthogonally interleaved double balun dipole antenna elements, which can be further configured into an array of such antenna elements.

16 Claims, 22 Drawing Sheets

DOUBLE BALUN DIPOLE

CROSS-REFERENCE TO RELATED APPLICATIONS

This Application is a Non-Prov of Prov (35 USC 119(e)) application 60/972,422 filed on Sep. 14, 2007.

TECHNICAL FIELD

The present invention is directed to an antenna element for an ultra wideband array antenna. More particularly, the invention is directed to a double Marchand balun dipole antenna element for an antenna array.

BACKGROUND OF THE INVENTION

There has been increasing interest in coincident phase center elements for electronically steered, polarization diverse, ultra wideband array antennas in recent years. This interest has arisen from the difficulty of maintaining the axial ratio of circularly polarized beams when scanning off-axis. When the constituent linear polarizations used to form circular polarization have adjacent phase centers, an angle dependant path length difference is introduced upon scanning. With increasing bandwidth, compensating for this path difference becomes more difficult. The motivation for developing ultra wideband coincident phase center antennas is to eliminate the scan dependant path length difference associated with adjacent phase center antennas.

Navy ships require electronically steerable antenna arrays capable of transmitting and receiving signals with polarization diversity, including circularly polarized waves, over large instantaneous bandwidth for satellite communications, electronic warfare, and other applications. Antenna element designs include those for operation using different polarizations, including linear (vertical or horizontal) and circular. These antenna elements are typically assembled into arrays for generating or receiving a collimated, directed RF beams.

To obtain polarization diversity, an antenna needs to radiate two orthogonal polarizations independently. This can be done with a pair of orthogonally positioned, linearly polarized elements. If electronic steering of circularly polarized beams is desired, then the linearly polarized elements must also have coincident phase centers to avoid degradation of circularity as the beam is scanned. The polarization purity degrades further in the case of wide instantaneous bandwidth signals.

Ultra wideband antenna arrays frequently employ flared notch radiators. This is because flared notch radiators usually do not have a strong resonance, but rather may be viewed as smooth tapers from a confined transmission line mode to a radiating free space mode. The difficulty with flared notches is that the individual radiators require conductive contact between adjacent elements to operate correctly at low frequencies within their design bandwidths Employing elements which do not require conductive contract between adjacent elements may free the designer from the difficulties of maintaining electrical contact between adjacent elements, but may introduce problem of obtaining large bandwidths from elements not known for wide bandwidth.

With regard to bandwidth enhancement, there are two frequency regimes to consider: the high frequency regime where in a half wavelength is less than the array cell size and the low frequency regime where in a half wavelength greater than the array cell size. The low frequency regime is more interesting for electronic beam steering applications while the high frequency regime is more interesting for fixed scan or broadside applications. In the low frequency regime a two to one bandwidth is readily attainable while maintaining simple construction methods. A four to one bandwidth is achievable with special construction techniques. The limits of the high frequency regime are encountered when interference between direct radiation from the dipoles, and reflected radiation from the ground plane behind the dipoles begins to form a null in the radiation pattern.

There are some trade off between low and high frequency performance. The more the bandwidth is extended in the low frequency regime, the greater the reflections seen in the high frequency regime. When the special construction techniques are employed to extend the bandwidth to 4:1 in the low frequency regime, there is very little bandwidth left in the high frequency regime.

A cross sectional view of a unit cell 10 in a coincident phase center array antenna with a coincident phase center flared notch element is shown in FIG. 1. This antenna is difficult to build because it must be constructed to maintain electrical continuity in multiple places for two interleaved perpendicular polarizations simultaneously. The first polarization is in the plane 12 of the sectional cut, and has its feed circuitry 14 exposed. The second polarization plane 16 is perpendicular to the section plane. Within a unit cell, it is important to maintain microwave electrical continuity across the slot 18 (further described below in an E-plane tee configuration). Between unit cells it is important to maintain microwave electrical continuity at the flare tips 20. Here microwave continuity implies control of the geometry of mating conductors so that the smooth flow of microwave fields can occur. Direct current continuity simply requires that mating conductors be in contact. The double balun dipole according this intention does not require continuity between unit cells in an array which greatly simplifies construction.

The next design to be considered is not a coincident phase center antenna, but it is introduced to help explain later designs. FIG. 2 shows a microstrip fed printed dipole with an integral balun by Edward and Rees, as described in U.S. Pat. No. 4,825,220, issued Apr. 25, 1989. It has a single Marchand balun 50 feeding the two arms of the dipole. It has a bandwidth 3 or 4 times greater than a traditional split sleeve dipole and it is fabricated using printed circuit techniques.

Before discussing the next patents/prior art, it will be useful to address microwave transmission lines. This will help to understand the shortcomings of the patents/prior art to be discussed. The classic transmission line is the parallel wire transmission line 60 shown in FIG. 3. The two conductors 62 are the same size, and the currents which flow on them are mirror images of one another. The difficulty with parallel wire transmission lines is that they must be protected from the rest of the world. A conductor that is allowed too close can cause reflections or permit extra modes to propagate, and dielectrics can change the characteristic impedance or introduce losses. A slot 64 is also shown in FIG. 3 as an example of balanced transmission line. Unless the conductors 66 and 68 on each side of the slot have the same cross-section, the transmission line mode it supports is only approximately balanced. In general slots tend to radiate, so it is desirable to keep them short with respect to a wavelength. In practice most microwave transmission lines are unbalanced lines such as those shown in FIG. 4. One conductor 70 is made much larger than the other conductor 72, and is often grounded. It shields the smaller conductor from the surroundings, making the circuit much easier to work with. Stripline has two ground conductors, but they are often joined with screws or plated vias, so it is similar to coaxial line. Direct connections between balanced and unbalanced transmission lines generally result in undesirable large reflections. Usually a balun circuit is inserted at the junction to enable proper flow of signals across the boundary.

The groundwork has been laid to consider the Wideband Phased Array Antenna and Associated Methods by Munk, Taylor, and Durham ("Munk et al."), as described in U.S. Pat. No. 6,512,487 and in "A Wide Band, Low Profile Array of End Loaded Dipoles with Dielectric Slab Compensation," Ben A. Munk, 2006 Antenna Applications Symp., pp. 149-165 ("Munk"), shown in FIG. 5. In the patent Munk et al. claims a 15:1 bandwidth, while in the paper Munk shows plots indicating a 9:1 bandwidth. Both are remarkable. Through the use of interdigital capacitors at the ends of the dipole arms, and selective use of dielectric layers, Munk and Munk et. al. have constructed a dipole array which is intrinsically well matched over an extremely wide bandwidth. Having constructed well matched dipoles, they must feed them with a balanced transmission lines. However, as I pointed out above, balanced transmission lines are undesirable because they need to be shielded. Munk et al. does not describe the particulars of the feed network in the patent. However, another patent, U.S. Pat. No. 6,483,464, Rawnick et al., describes a feed network and associated feed line organizer, shown in FIG. 6, which they state is suitable for the dipole array antenna patented by Munk et al. Rawnick et al. state that the feed line organizer suppresses common mode currents. Indirectly, this may be an affirmation of the difficulty noted above with balanced transmission lines. An isolated single two conductor transmission line should support only one mode of propagation. If a second two conductor transmission line is brought into close proximity of the first, the result is a four conductor transmission line which can support unwanted modes. The self-shielding of unbalanced transmission lines reduces the coupling to nearby transmission lines. In effect, Rawnick et al. has replaced two balanced transmission lines in close proximity with four unbalanced transmission lines with the feed line organizer. A 180 degree hybrid circuit is also shown in FIG. 6. The balanced transmission line mode of Munk et al. and Munk's dipole still needs to be converted to an unbalanced mode.

Typically a 180 degree hybrid has several quarter wavelength sections. This is at some intermediate frequency, not the highest frequency. However the space available is a square one half wavelength on a side, and this is at the highest frequency. The size of the circuit can be reduced by the use of high dielectric constant materials, but only to a point. Practical circuit processing techniques limit how small features of a circuit can be made. Munk's design is very clever. However the dipole according to this invention has the advantage of providing unbalanced transmission line modes right at the terminals of the antenna. The conversion from a balanced mode to an unbalanced mode is implemented more efficiently in less space with a double Marchand balun dipole than with a balanced dipole, feed line organizer, and 180 degree hybrid. Munk notes that his design is capable of dual polarized operation, but he does not mention coincidence of phase centers. It is therefore desirable to provide a dipole antenna without these deficiencies.

BRIEF SUMMARY OF THE INVENTION

According to the invention, a double balun dipole antenna element includes a dielectric substrate having a first surface and an opposing second surface, a pair of coplanar Marchand baluns positioned in a mutually antiphase configuration on the first and second surfaces, and at least one feed line connected to the pair of Marchand baluns. In the microstrip embodiment, the dipole is positioned on the surface opposite the feed line. In the stripline embodiment, the feed line is positioned as is described below. A doubly polarized antenna element includes a pair of orthogonally interleaved double balun dipole antenna elements, which can be further configured into an array of such antenna elements.

With this invention, dipoles are employed as radiating elements. A technique using two Marchand baluns, one for each arm of the dipole, is introduced for enhancing the bandwidth of dipole radiators. Herein the Marchand baluns server two purposes: (1) converting the balanced field mode of the dipole to the unbalanced mode of the transmission line, and (2) matching the capacitive loading of adjacent dipoles.

The advantages of the double Marchand balun dipole of the invention vary depending on the particular embodiment. However, an advantage common to all embodiments is that it operates over a considerably wider bandwidth than most dipole antennas.

The invention, unlike a dual-polarized microstrip notch antenna, does not require electrical continuity between contiguous elements, greatly simplifying and reducing the costs of its construction.

The insight gained from designing ultra wideband coincident phase center elements can be used to redesign more narrow band elements to have coincident phase centers. Of course the unique characteristics of different elements must be accounted for with any new design. This method is applied to dipoles with this invention. At the same time, some emphasis will be placed on keeping the resulting design simple.

Two double Marchand balun dipoles can be arranged so that they are mutually perpendicular to each other and yet share a common physical center. In this configuration they can be used for coincident phase center applications. Coincident phase center applications are likely to be associated with electronic beam steering. Electronic beam steering implies element spacing of approximately a half wavelength or less—the low frequency regime. The bandwidth of the double Marchand can be expanded in the low frequency regime by making the arms of the dipoles longer, the limit being half the cell size of the array. A two to one bandwidth is easily attainable. A four to one bandwidth is attainable by using capacitors between dipoles as Munk did. In this embodiment, the advantage of the double Marchand balun dipole is that its ports are unbalanced transmission lines.

The double Marchand balun dipole can be used in wideband single polarized applications also. The bandwidth can be increased in the low frequency regime for single polarization applications the same way it is for coincident phase center applications. I do not believe ordinary split sleeve balun dipoles are susceptible to the same type of bandwidth enhancement. I have observed mutual coupling induced bandwidth enhancement with the Edward's dipole, but I believe the double Marchand balun dipole is susceptible to more enhancement.

The double Marchand balun can be used as an array element in the high frequency regime also. In this frequency range it is more likely to be useful for fixed scan or broadside applications.

The double Marchand balun dipole has usefulness in single or isolated antenna applications.

DETAILED DESCRIPTION OF THE INVENTION

Figure 7A:
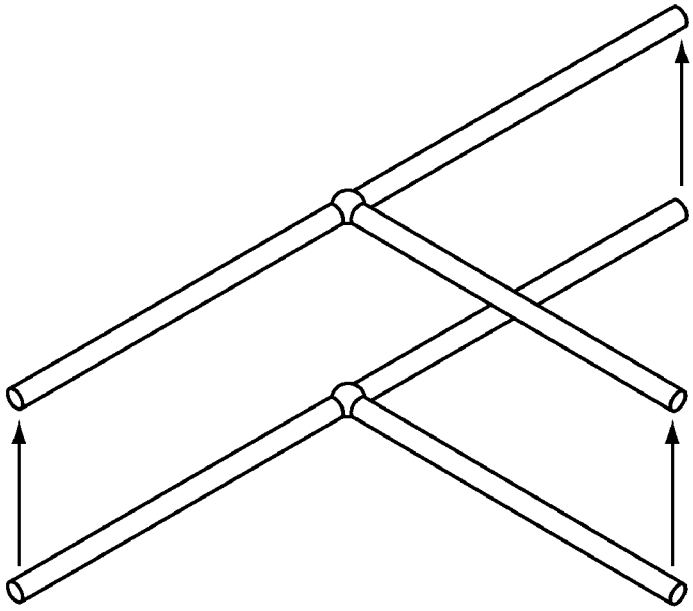
FIG. 7A PRIOR ART
FIGS. 7A-B respectively illustrate a regular and an E-plane transmission line tee.
Figure 7B:
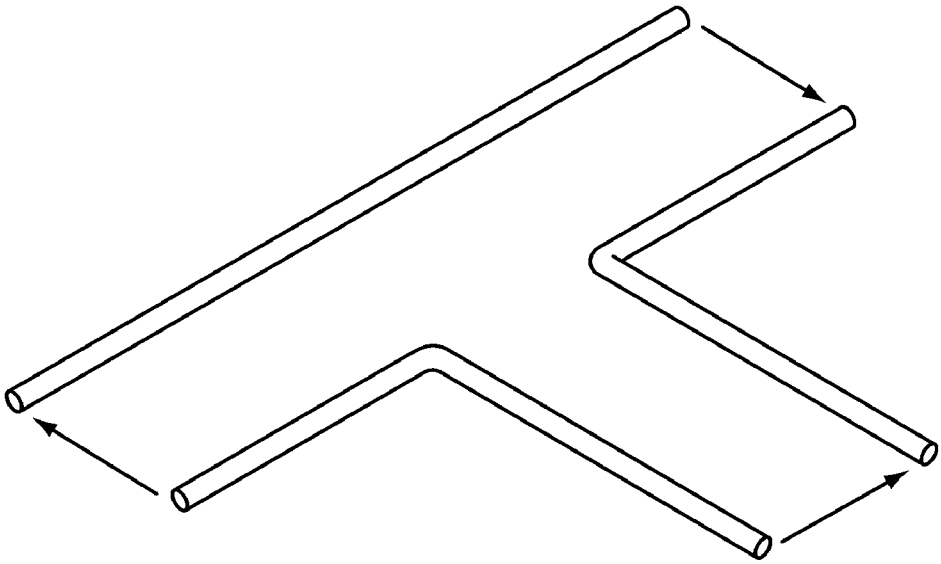
FIG. 7B PRIOR ART

Before going into detail on operation and construction of the double Marchand balun dipole of the invention, it may be helpful to elaborate on the difference between a regular tee and E-plane tee. The term "E-plane tee" is borrowed from waveguide usage. Both type of transmission line tees are shown in FIGS. 7A-B. The tee in FIG. 7A is a regular tee. The electric field has the same polarity at both outputs. The tee in FIG. 7B is an E-plane tee. The electric field at the outputs has opposite polarity. Both tees can be implemented with balanced transmission line topology. The E-plane tee cannot be implemented with unbalanced transmission line topology. This is because the roles the two conductors play, as "shield" and "center conductor" would have to be reversed at the two output arms.

Figure 1:
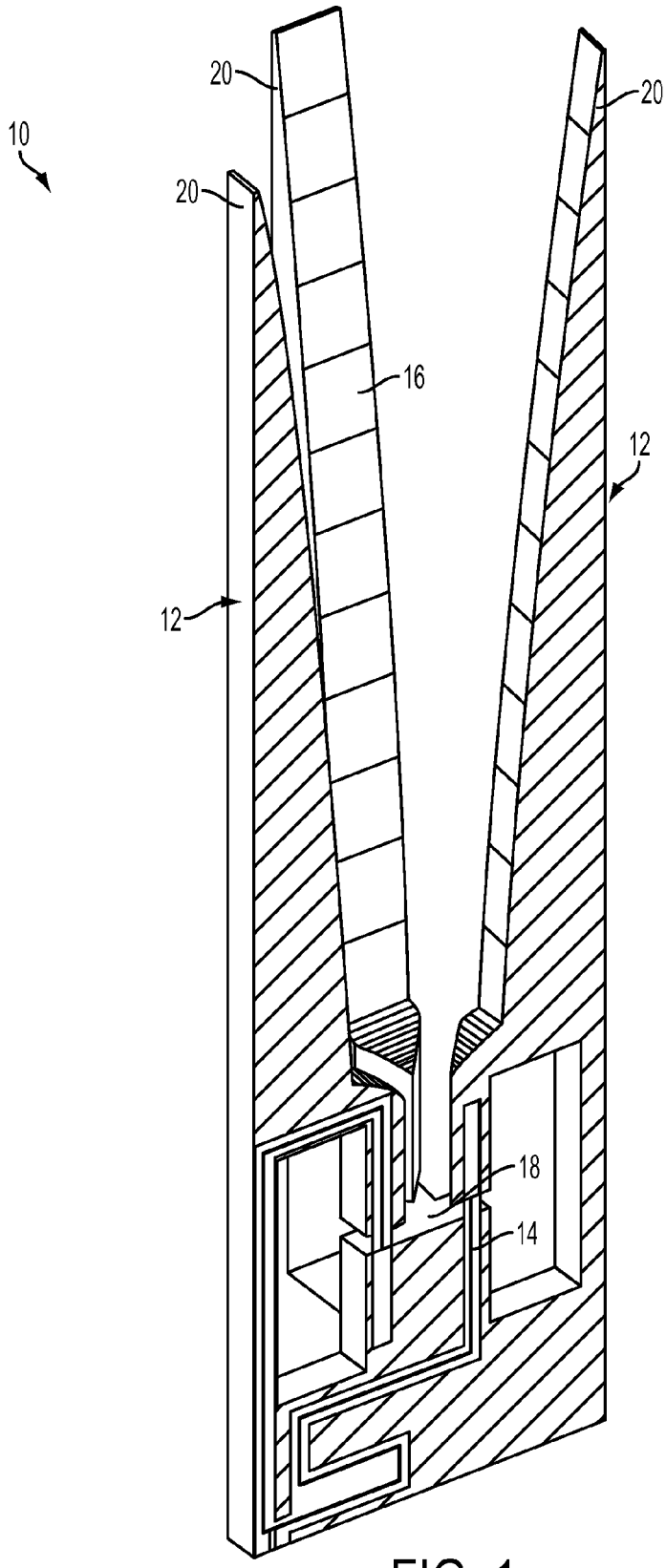
FIG. 1 PRIOR ART
FIG. 1 is a coincident phase center array antenna with a coincident phase center flared notch element.
Figure 2:
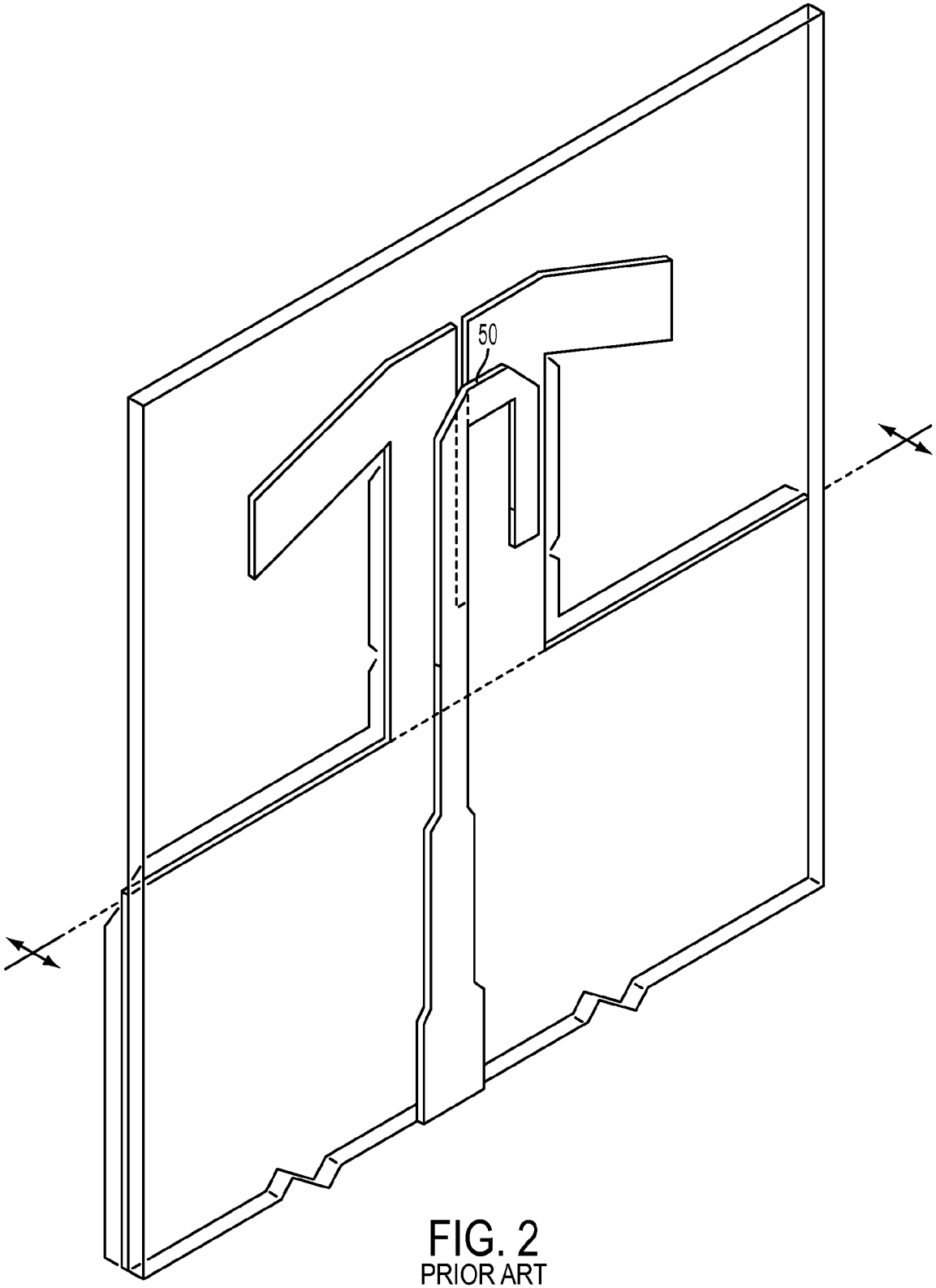
FIG. 2 PRIOR ART
FIG. 2 is a microstrip fed printed dipole with an integral balun.
Figure 3:
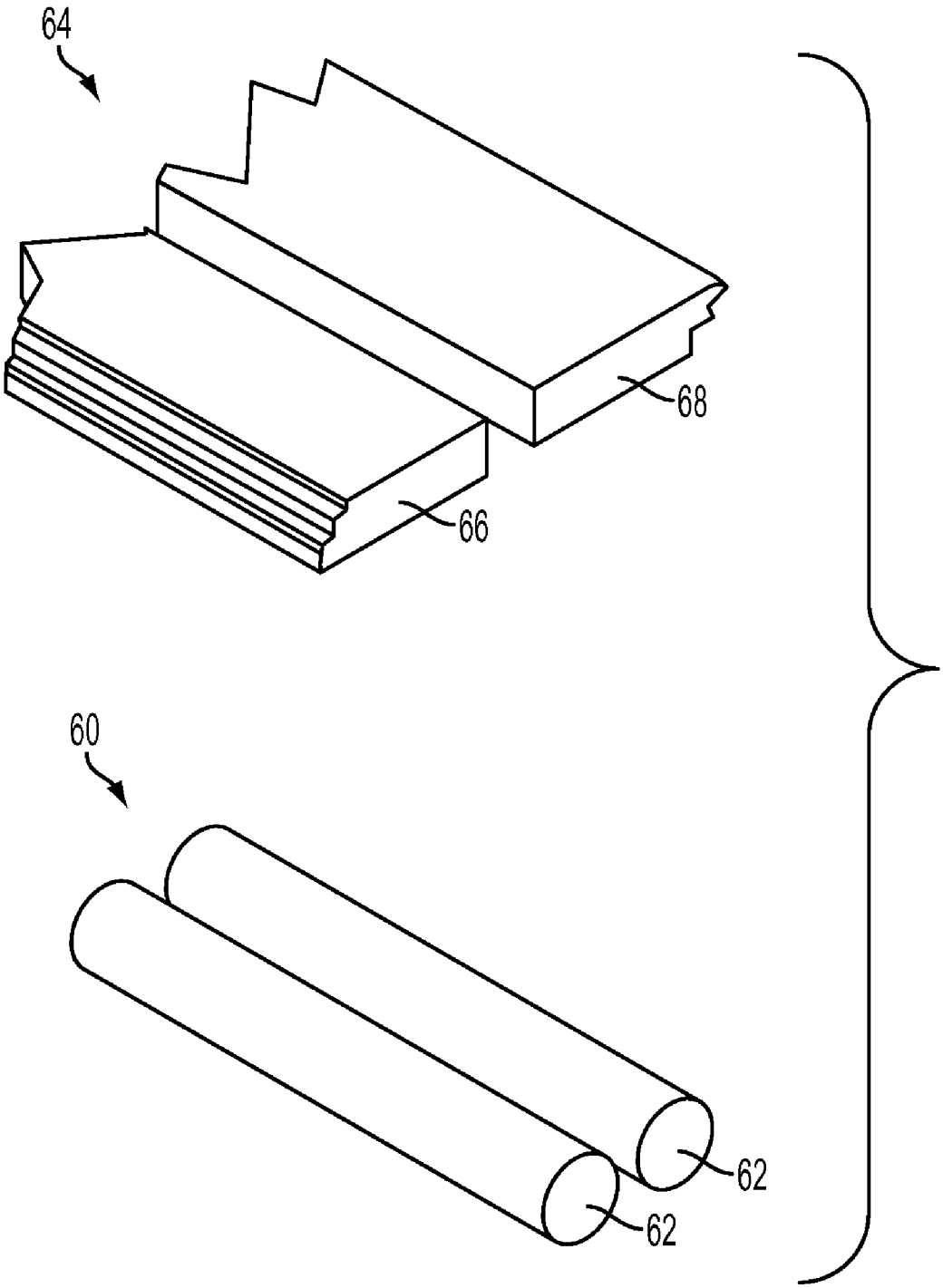
FIG. 3 PRIOR ART
FIG. 3 illustrates parallel wire and slot balanced transmission lines.
Figure 4:
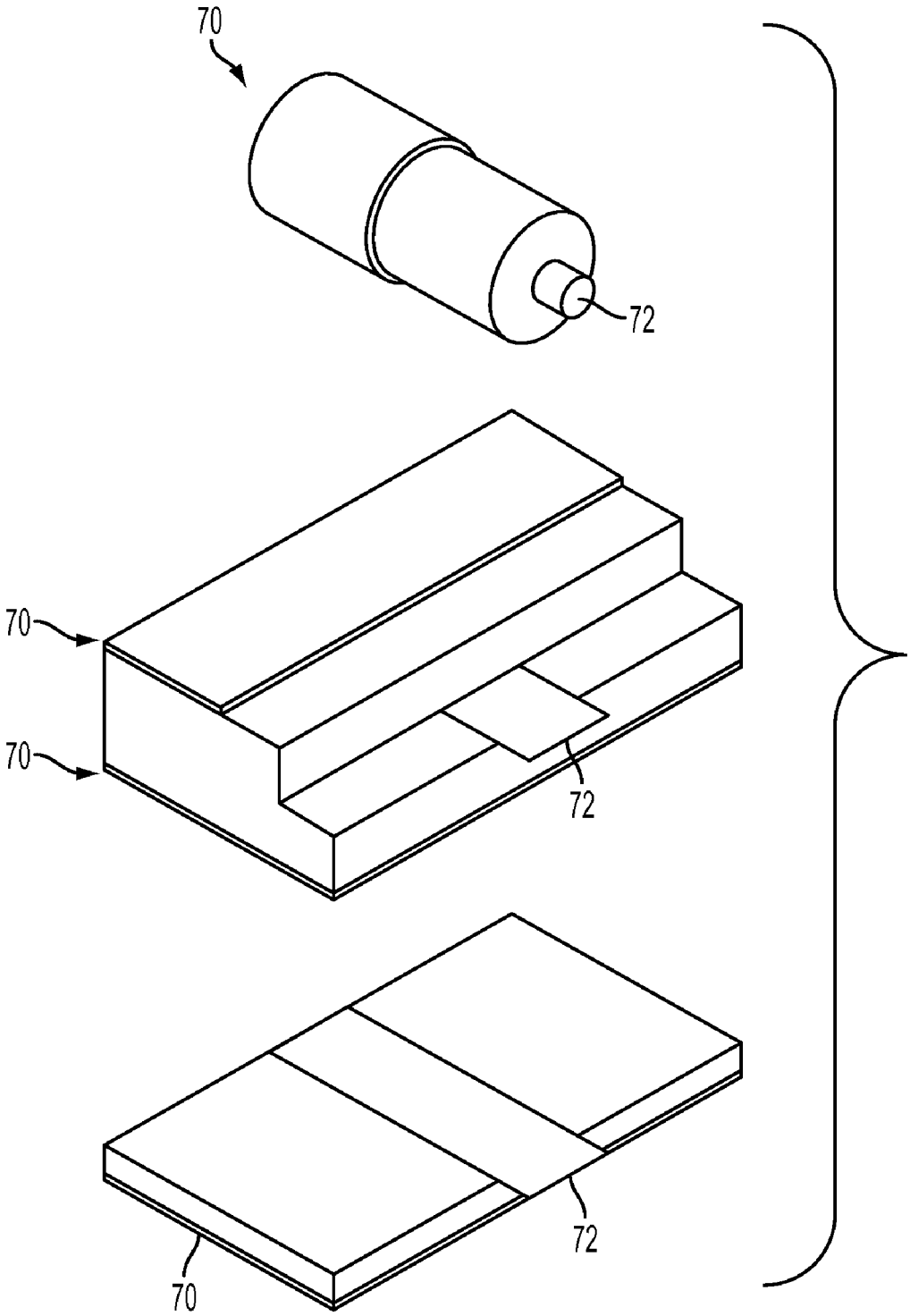
FIG. 4 PRIOR ART
FIG. 4 illustrates coax, stripline, and microstrip unbalanced transmission lines.
Figure 8:
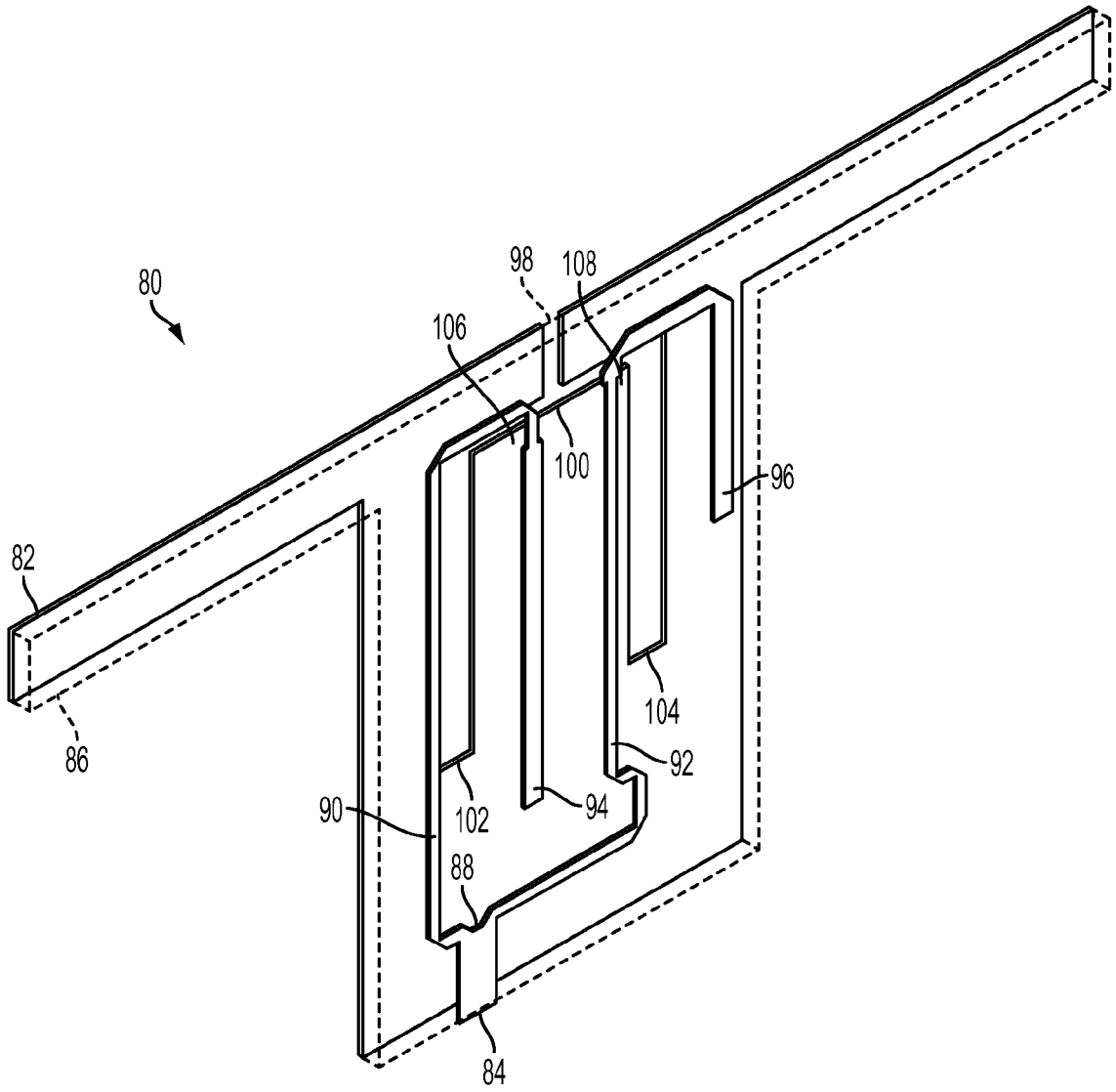
FIG. 8 is a schematic illustration of a double Marchand balun feed according to the invention.

Referring back to FIG. 4, a double balun dipole can be implemented with either microstrip or stripline circuit methods. A double balun dipole 80 implemented with microstrip techniques is shown in FIG. 8 (in this drawing, the top, dielectric substrate is shown in phantom so that both the top and bottom sides may be shown in the one figure). It consists on the bottom side of a conducting dipole 82 and on the opposing top side a conducting feed circuit 84 printed on a dielectric substrate 86. The feed circuit consists of a tee 88, feed lines 90 and 92, and open circuited stubs 94 and 96. Nominally the feed lines 90 and 92 have the same electrical length although they may follow different contours. The same applies to the open circuited stubs 94 and 96. The dipole 82 is bifurcated at its midpoint by slotline 98 which leads to E-plane tee 100. E-plane tee 100 feeds short circuited slotline stubs 102 and 104 (thus positioned on the bottom, conducting dipole 82 side, i.e. the side opposite the top side of stubs 94 and 96) in anti-phase. Nominally the short circuited stubs 102 and 104 have the same electrical length. Feed lines 90 and 92 cross short circuited stubs 102 and 104, in opposite directions, at symmetrical distances, which are kept as short as possible, from E-plane tee 100. Immediately upon crossing short circuit stubs 102 and 104, feed lines 90 and 92 transition into open circuit stubs 94 and 96 which may have the same or different widths as feed lines 90 and 92. Collectively open circuit stub 94 and short circuit stub 102 form a Marchand balun 106, and open circuit stub 96 and short circuit stub 104 form a Marchand balun 108. In essence, the single Marchand balun of Edward's design, FIG. 5, has been replaced with two counter-phased Marchand baluns joined with an E-plane tee.

Figure 9:
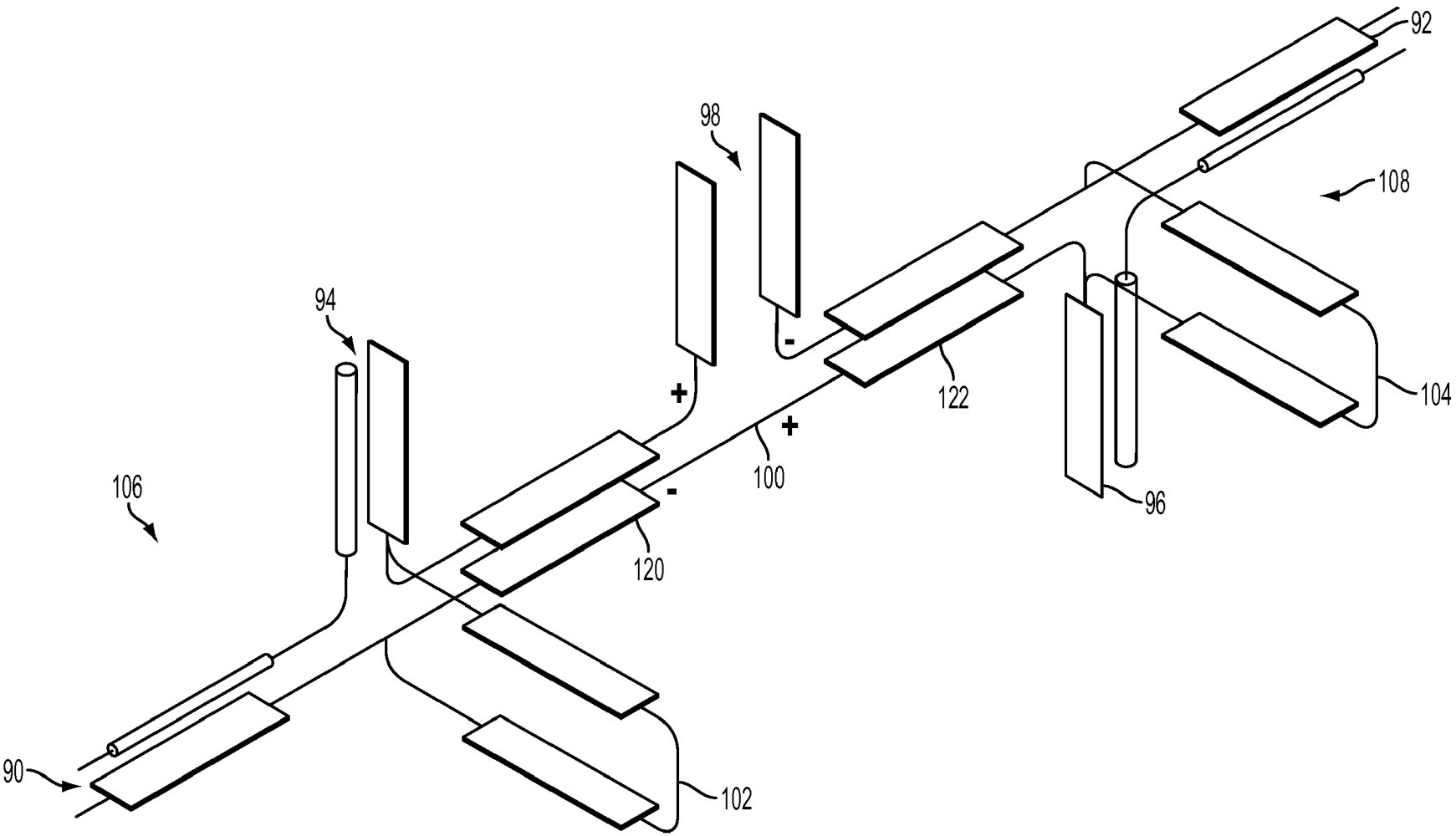
FIG. 9 is a schematic illustration of the balun and slotline portions of FIG. 8.

The balun and slotline portions of FIG. 8 are shown schematically in FIG. 9. In this schematic unbalanced transmission lines are shown as small round conductors adjacent to flat conductors while balanced transmission lines are shown as to two adjacent flat conductors. Unbalanced feed lines 90 and 92, with signals which are in phase, feed Marchand baluns 106 and 108 respectively. Marchand balun 106 consists of open circuited stub 94 in series with input 90 and short circuited stub 102 in parallel with output 120. Similarly Marchand balun 108 consists of open circuit stub 96 in series with input 92 and short circuited stub 104 in parallel with output 122. Marchand balun 106 and 108 are oriented so as to feed balanced transmission lines 120 and 122 with signals which are oppositely phased. These signals are combined by E-plane tee 100 and passed to balanced transmission line 98. Optimally, balanced transmission lines 120 and 122 are kept as short as possible to minimize the distance between the E-plane tee and the Marchand baluns. Note that the short balanced lines 120 and 122 were not distinguished from stubs 102 and 104 in FIG. 8. They were drawn with the same width as stubs 102 and 104, and specifically identifying them might have been confusing.

Figure 10:
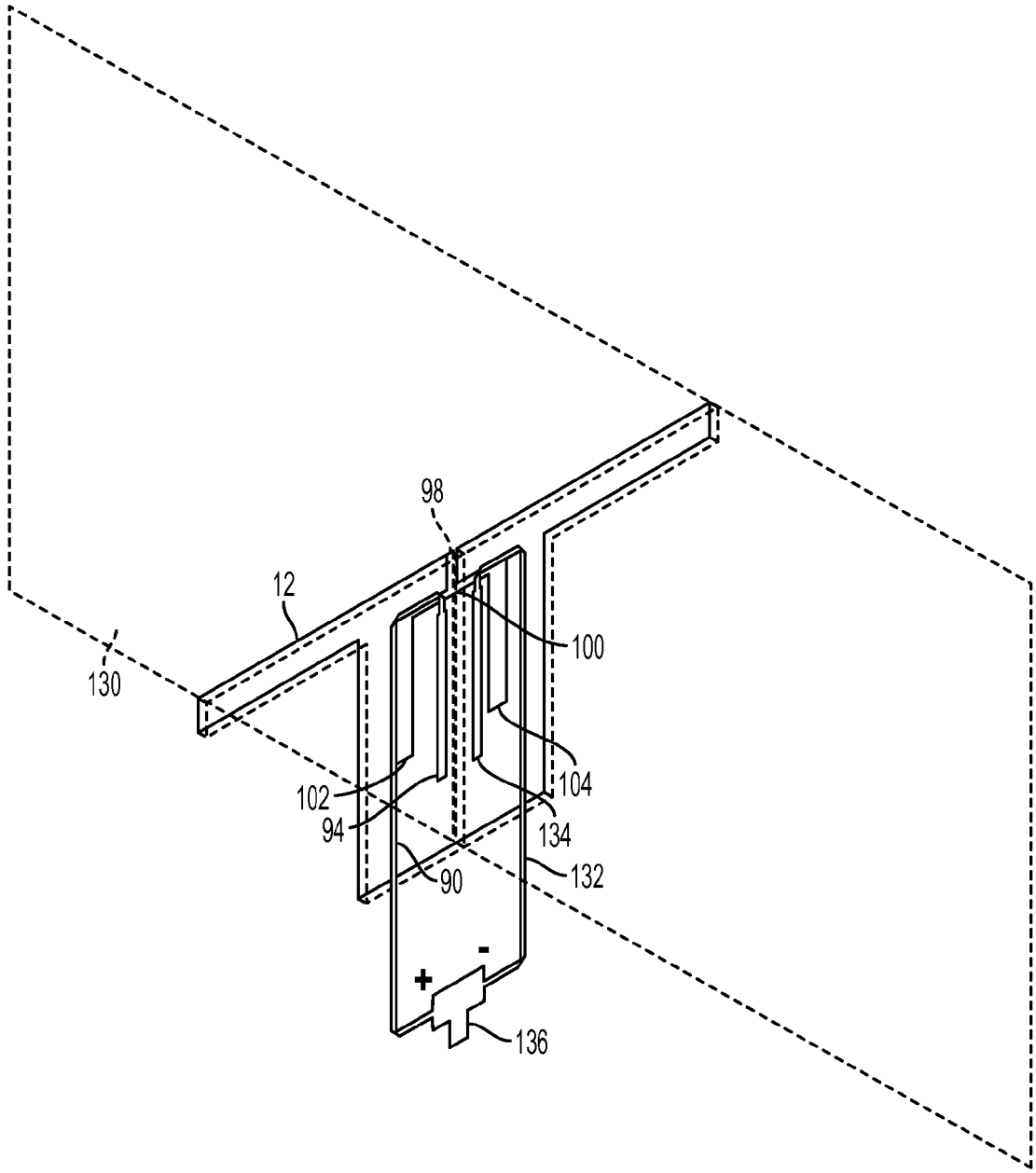
FIG. 10 is alternative representation of the double balun dipole of FIG. 8.

An alternative representation of the double balun dipole, useful for further explaining its operation is shown in FIG. 10. The left and right halves of dipole and feed circuit are shown as reflections of one another in mirror plane 130. The dipole 12, slot 98, E-plane tee 100, feed line 90, open circuited stub 94 and short circuited stubs 102 and 104 are the same as shown in FIG. 8. The feed line 132 and open circuited stub, 134, on the opposite side are exact mirror images of the first. The direction in which feed line 132 crosses short circuited stub 104 is the same as that in which feed line 90 crosses short circuited stub 102 so the reversal in phase between the two sides of the dipole is obtained with a 180° hybrid circuit 136.

Array Embodiment

Figure 11:
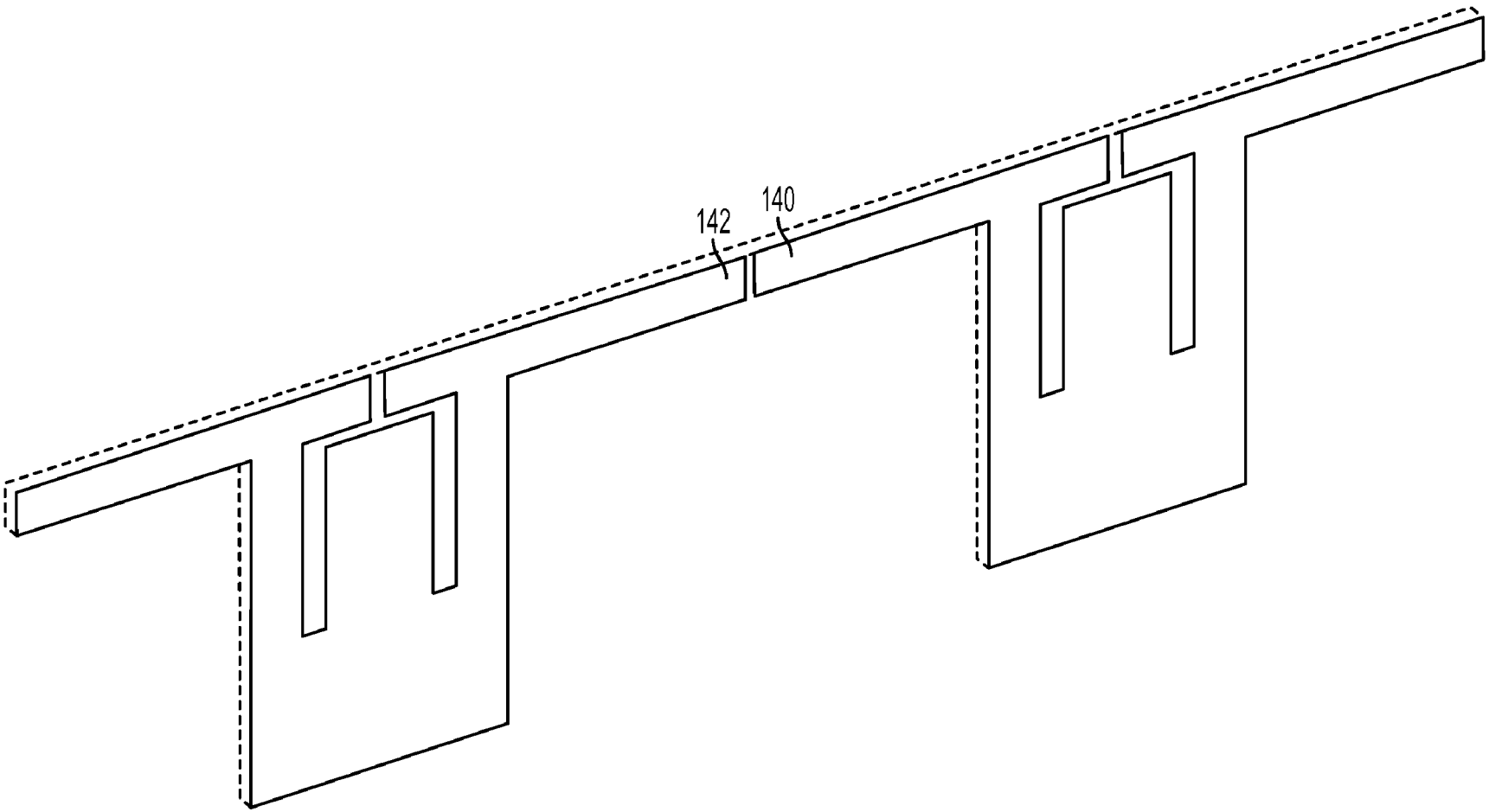
FIG. 11 is a schematic illustration of double Marchand balun dipole radiators positioned end to end or in linear arrays as integrally constructed on circuit boards according to the invention.
Figure 12:
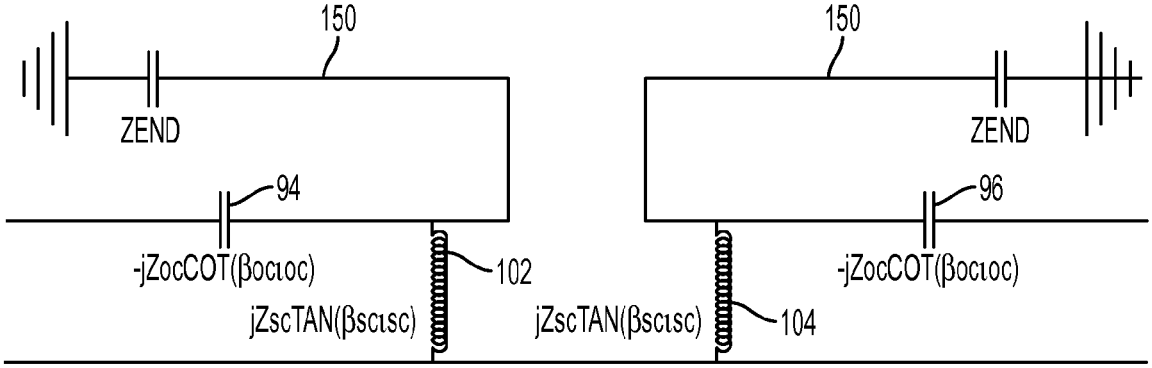
FIG. 12 is an equivalent circuit representation of the configuration shown in FIG. 9.

Double Marchand balun dipole radiators may be integrally constructed on circuit boards and positioned end to end or constructed in linear arrays on circuit boards as shown in FIG. 11. Bandwidth enhancement is obtained by making the arms of adjacent dipoles 140 and 142 approach each other closely taking advantage of the capacitive coupling noted by Munk. As the capacitive loading increased, the reactive fields of the dipole change, and the lengths of the open and short circuited stubs in the Marchand baluns may be changed to compensate. This can be seen by redrawing the schematic in FIG. 9 to emphasize the circuit parameters rather than the transmission line characteristics of the double Marchand balun. Referring to FIG. 12, open circuited stubs 94 and 96 are represented by capacitors with impedance $-jZ_{oc}\,COT(\beta_{oc}l_{oc})$ and short circuited stubs 102 and 104 are represented by inductors with impedance $jZ_{sc}\,TAN(\beta_{sc}l_{sc})$ where $Z_{oc}$, is the characteristic impedance of the open circuited stubs, $\beta_{oc}$ is the propagation constant of the open circuited stubs, $l_{oc}$ is the length of the open circuited stubs, $Z_{sc}$ is the characteristic impedance of the short circuited stubs, $\beta_{sc}$ is the propagation constant of the short circuited stubs, and $l_{sc}$ is the length of the short circuited stubs.

The end loading is represented by impedances $Z_{end}$ which is the capacitive end loading already mentioned transformed by the length of the monopole 150. The schematic in FIG. 12 is not complete enough to design a double Marchand balun dipole. Rather, it is presented to show how the Marchand baluns may be adjusted to tune the dipole. Parameters $Z_{oc}$ and $Z_{sc}$ are related to the widths of open and short circuited stubs, while parameters $l_{oc}$ and $l_{sc}$ are related to the lengths of the open and short circuited stubs. Numerous simulations have been performed for various double Marchand balun dipoles. In general it has been noted that as the capacitive loading is increased, range of stub parameter which will produce acceptable match decreases. A bandwidth of three to one with a reflection less than −10 dB is obtainable with reasonable dimensions. A design with a 2.5 to 1 bandwidth extending into both the high and low frequencies regimes was constructed. Designs with bandwidths as great as four to one, entirely in the low frequency regime have been simulated. However, the dimension of such designs may be difficult to realize in practice.

Stripline Embodiment

Figure 13:
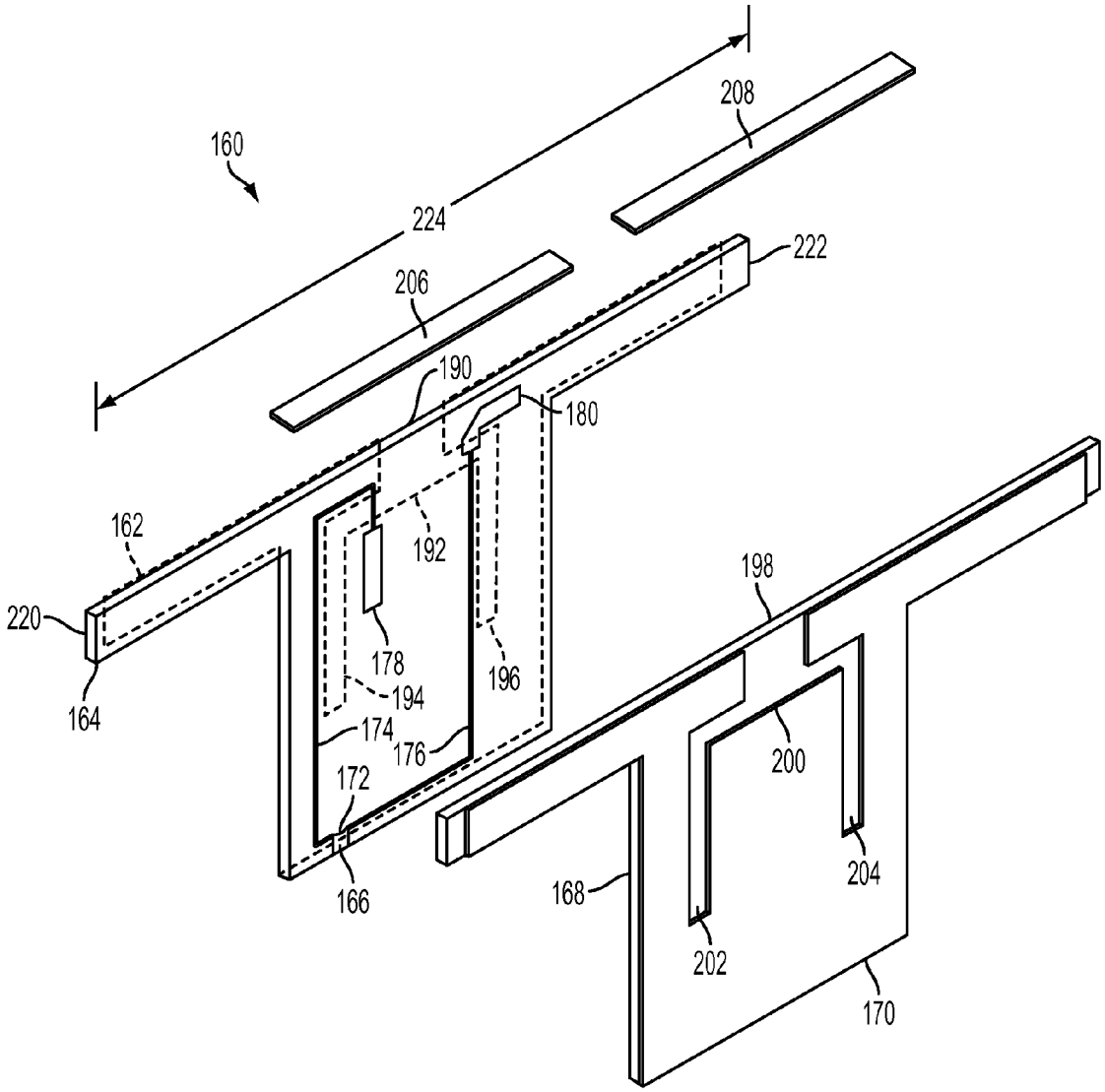
FIG. 13 is exploded view of a stripline dipole comparable to the microstrip dipole shown in FIGS. 11 and 8 according to the invention.

Referring back to FIG. 4, stripline and microstrip are two common circuit design topologies used in microwave circuit design. All the diagrams of double Marchand balun dipole antennas presented above have featured microstrip designs. This was done to make the diagrams simpler. Stripline, however, may be constructed so that it is symmetrical about the plane of the circuit trace. When applications requiring polarization purity are required, a stripline double Marchand balun dipole design may be preferred. An exploded view of a stripline dipole 160, comparable to the microstrip dipole shown in FIGS. 11 and 8, is shown in FIG. 13. Double Marchand balun dipole 160 consists of a first conducting dipole layer 162, a first dielectric substrate 164, a conducting feed circuit layer 166, a second dielectric substrate 168, and a second conducting dipole layer 170, all respectively sandwiched together in that order.

Feed circuit 166 consists of a tee 172, feedlines 174 and 176, and open circuited stubs 178 and 180. Nominally feedlines 174 and 176 have the same electrical contours although they may follow different contours. The same applies to the open circuited stubs 178 and 180.

The first conducting dipole layer 162 is bifurcated at its midpoint by slot 190 which leads to slot tee 192. Slot tee 192 feeds short circuited slotline stubs 194 and 196. Nominally the short circuited stubs 194 and 196 have the same electrical length. Feed lines 174 and 176 cross short circuited stubs 194 and 196, in opposite directions, at symmetrical distances, which are kept as short as possible, from slot tee 192.

The second conducting dipole 170 is bifurcated at its midpoint by slot 198 which leads to slot tee 200. Slot tee 200 feeds short circuited slot line stubs 202 and 204. Nominally dipoles 162 and 170, and all the features and contours contained within are identical and aligned with each other while being mutually offset through the thickness of dielectric layers 166 and 168.

Conductors 206 and 208 join dipoles 162 and 170 across top edges of dielectric substrate layers 164 and 168. Electrically dipole layers 162 and 170 and all the features contained within act as one unit.

Open circuited stub 178, and short circuited stubs 194 and 202 constitute a first Marchand balun which corresponds to Marchand balun 106 in FIG. 9. Open circuited stub 180, and short circuited stubs 196 and 204 constitute a second Marchand balun which corresponds to Marchand balun 108 in FIG. 9. Slot tees 192 and 200 form an E-plane tee which corresponds to E-plane tee 100 in FIG. 9. Finally slots 190 and 198 form a slot line which corresponds to balanced transmission line 98 in FIG. 9.

Finally substrates layers 164 and 168 extend beyond conducting dipole layers 162 and 170 by to form symmetrical taps 220 and 222. These preclude electrical contact between conducting dipoles 162 and 168 and corresponding features on adjacent dipoles.

Figure 14:
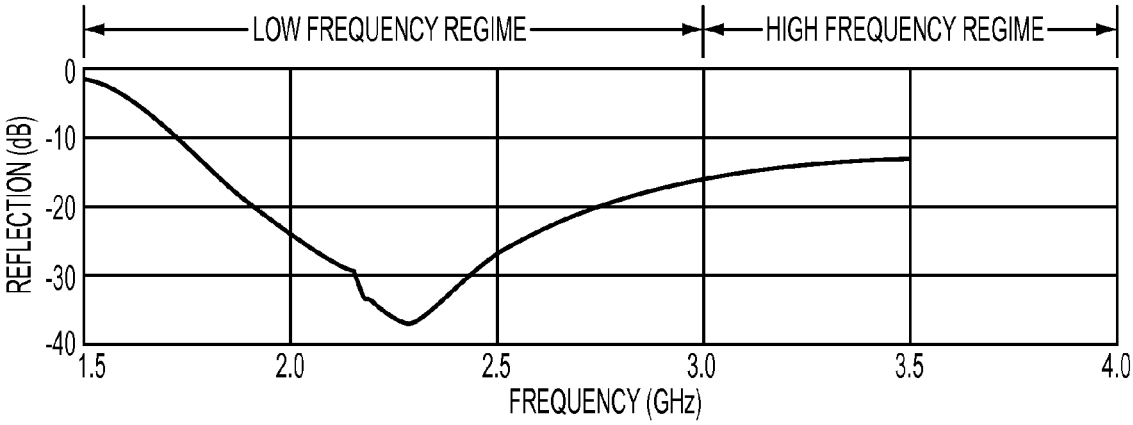
FIG. 14 is the calculated response for the dipole of FIG. 13.

The calculated response for the dipole shown in FIG. 13, with a unit cell size 224 of 2000 mils, is presented in FIG. 14.

End and Edge Elements

Frequently the end elements in linear arrays and edge elements in planar arrays are not as well matched as interior elements. This is because the elements are designed to accommodate the effects of mutual coupling. The edge and end elements have some of the mutual coupling they have been designed for removed, and as a result function poorly. The simulations discussed earlier used software waveguide simulators to model the effects of mutual coupling. The perfect electric walls are mirrors. The elements, optimized in the presence of mirrors, do not function properly when the mirrors are removed.

A common practice in array design is make the end and edge elements into dummy elements. They are match terminated at their ports with resistors, but they are not connected to any beam forming network. Their only purpose is to provide mutual coupling to the next tier of elements in the array. The number of dummy elements to use in an array depends on the level of mutual coupling, the sensitivity of the system to mismatches, and other space and cost considerations.

Figure 15A:
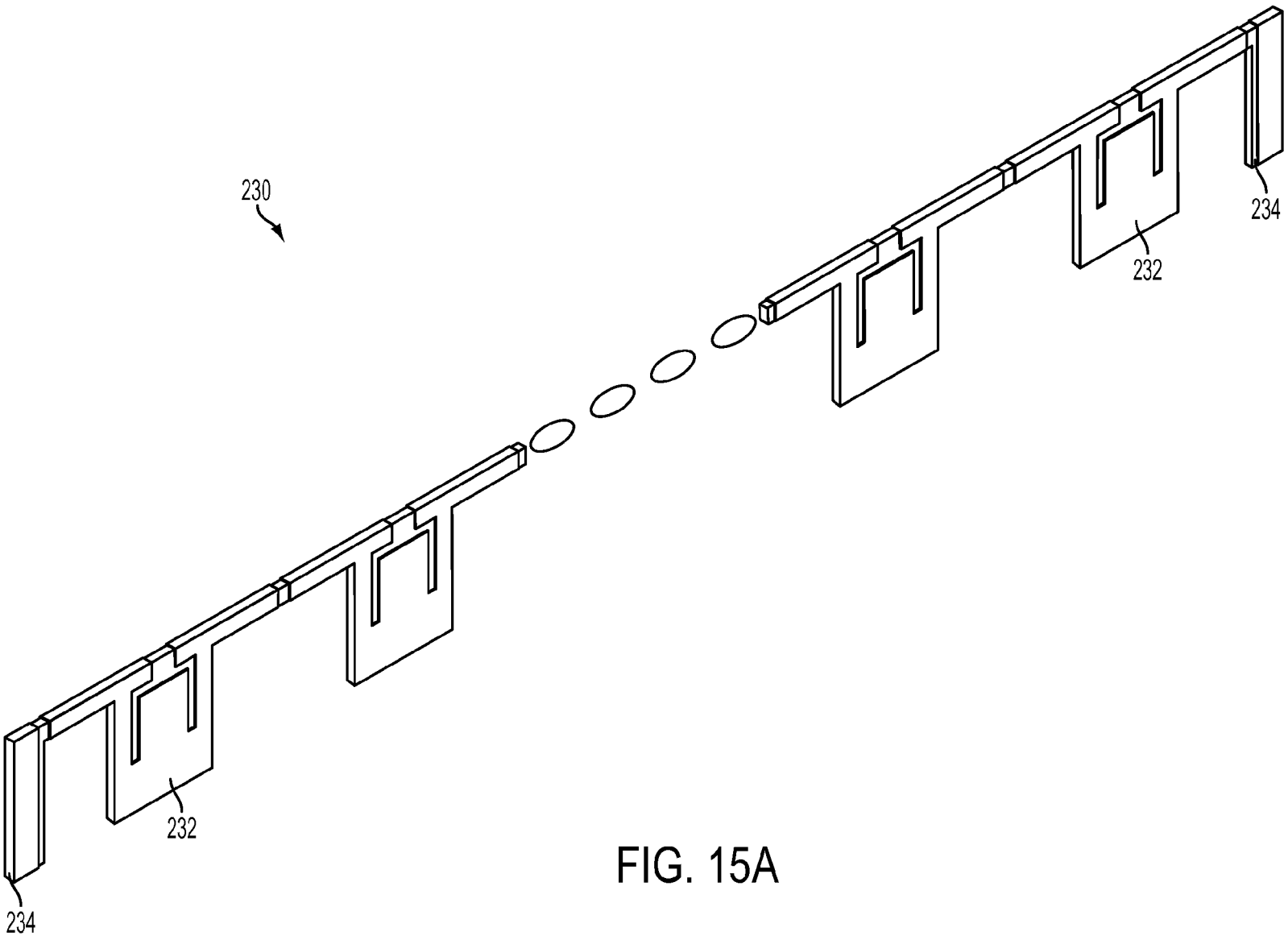
FIGS. 15A-B are double Marchand balun dipoles at the end or edge of an array according to the invention.
Figure 15B:
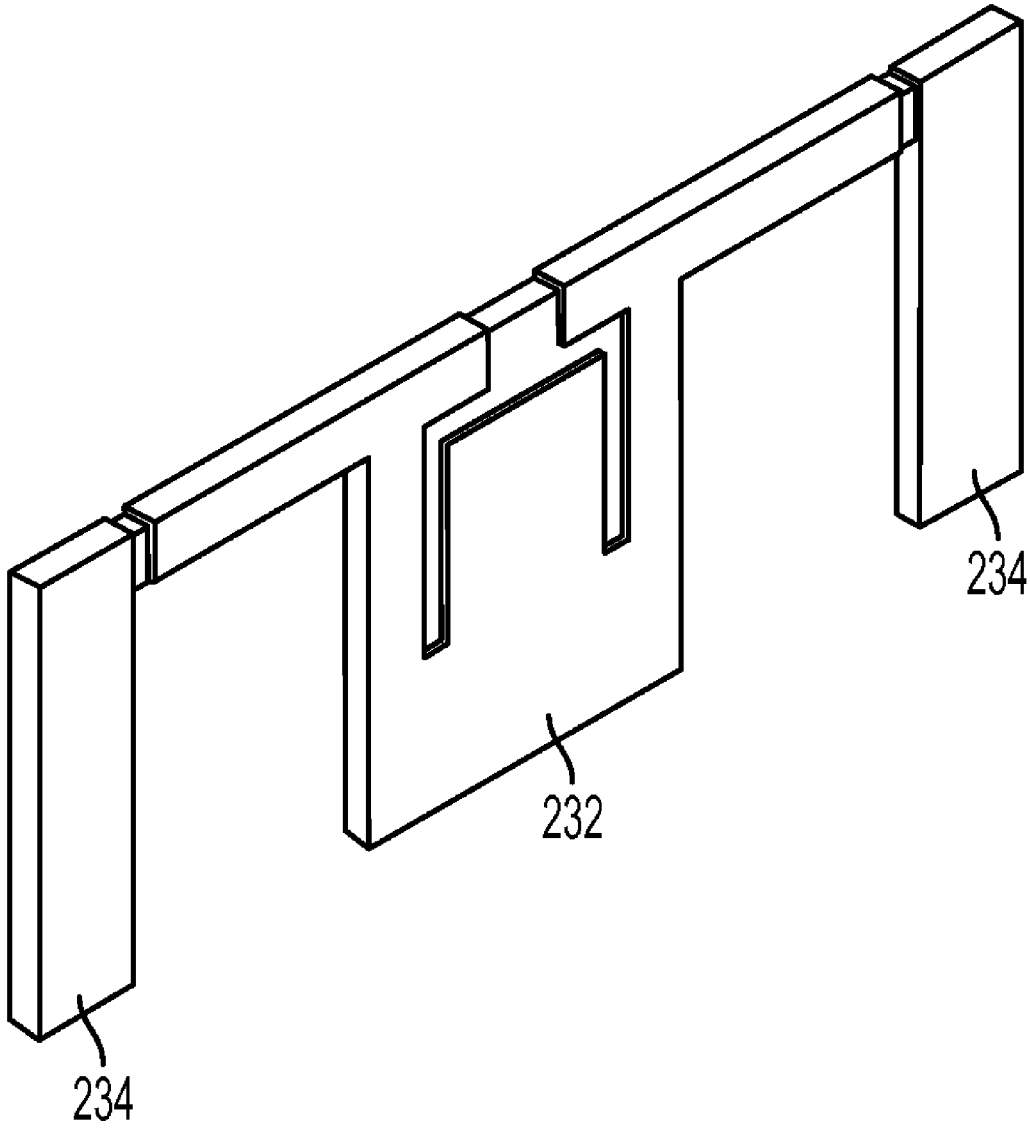

Referring to FIG. 15A, a double Marchand balun dipole at the end or edge 232 of an array 230 can have its impedance match improved by placing a grounded conducting tab 234 on the outside edge of cell boundary in the plane of the dipole. The configuration shown in FIG. 15A may require too much memory for some numerical simulation tools. FIG. 15B shows a substitute configuration for designing the end tabs. A double Marchand balun 232 with the relative dimensions discussed above with respect to FIG. 13, and with conducting tabs 234 at each end is shown. The height of the tab was chosen to be the same as the height of dipole 232. The separation between the tab and the dipole was chosen to be the same as the inter-element spacing, and the width of the tab was found empirically with a numerical simulator.

Figure 16:
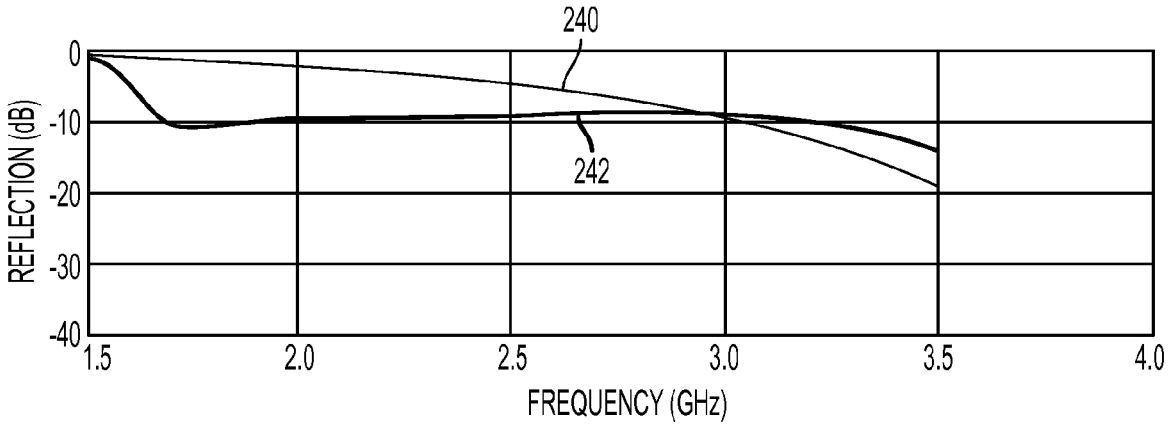
FIG. 16 is the calculated response for the element without conducting end tabs and the calculated response for the element with conducting end tabs according to the invention.

FIG. 16 shows the calculated response 240 for the element without conducting end tabs and the calculated response 242 for the element with conducting end tabs. These can be compared to FIG. 14 which gives the calculated response for same dipole in an infinite planar array environment.

It should be noted that FIG. 15B depicts a situation worse than what an end or edge element would actually experience. In FIG. 15B there are no other elements in the E-plane, but in an array there would be neighboring elements on one end. Thus the response 242 is worse than what would be encountered. The actual responses would be somewhere in between what is shown in FIG. 14 and FIG. 16. As a general rule, −10 dB reflection is the dividing line between matched and unmatched. The curve for conducting tabs in FIG. 16 is almost acceptable, so in actual array environment, with mutual coupling from one side, the end element 232 in FIG. 15A might be acceptable as an active element.

This method of end element response enhancement was tested experimentally. An eight element array was constructed with conducting tabs placed adjacent to the end elements. The measured array gain and patterns were consistent with what would be expected for an eight element array, not a six element array, indicating that the end elements were functioning well.

Dual Polarized

Figure 17A:
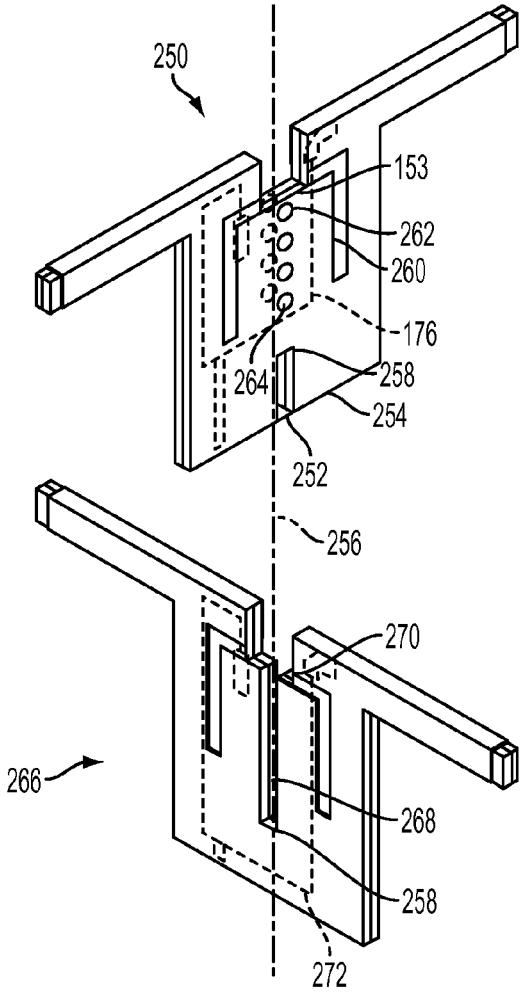
FIGS. 17A-B are schematic illustrations of an assembly of two perpendicular stripline dipoles according to the invention.

The double Marchand Balun dipole is well suited to radiate two perpendicular linear polarized radiation patterns with coincident phase centers. This is a result of the highly symmetric nature of its construction. Considering the stripline embodiment first because it has perfect symmetry, refer to FIG. 17A. Here the construction of two perpendicular dipoles, following the method described in FIG. 13 is shown. The first dipole, 250, has an upward protruding slot 252, which begins at the lower edge of the element 254, and follows element center 256 to some intermediate point 258. Point 258 is chosen to be sufficiently far from feed line 176 that no disruption of signals propagating on it will occur. Several conducting vias 260, are added to the construction of FIG. 13 as follows. The vias pass through dielectric layers 164 and 168 to make electrical contact between conducting dipole surfaces 162 and 170. The vias 260 are positioned so that their centers lie along element center 256. The topmost via 262 is positioned as close to E-plane tee, 153, as construction techniques will permit. The bottommost via 264 is positioned sufficiently far from feed line 176 that no disruption of signals propagating on it will occur. The second dipole 266 follows the construction in FIG. 13 with the following modification: A downward protruding slot 268 is cut from the bottom edge of E-plane tee 270, to the same intermediate point 258 previously specified, along element center 256. The path of feed line 272 is lowered to some intermediate level such that signals propagating on it will not be disrupted by proximity to downward protruding slot 268 or edge 274. The width of slots 252 and 268 are made slightly larger than the thicknesses of elements 250 and 266.

Figure 17B:
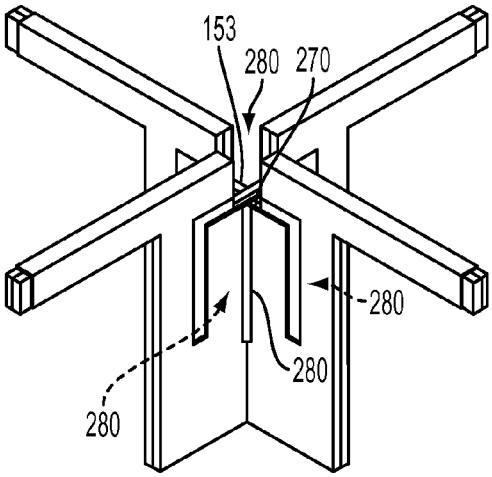

In FIG. 17B, the assembly of dipoles 250 and 266 is shown. Dipole 250 passes through slot 268 and dipole 266 passes through slot 252 so that the tops of elements 250 and 266 are flush. Finally, the four seams 280 between the dipoles are soldered with attention to getting the seams to extend as close to E-plane tees 153 and 270 as possible.

Figure 18A:
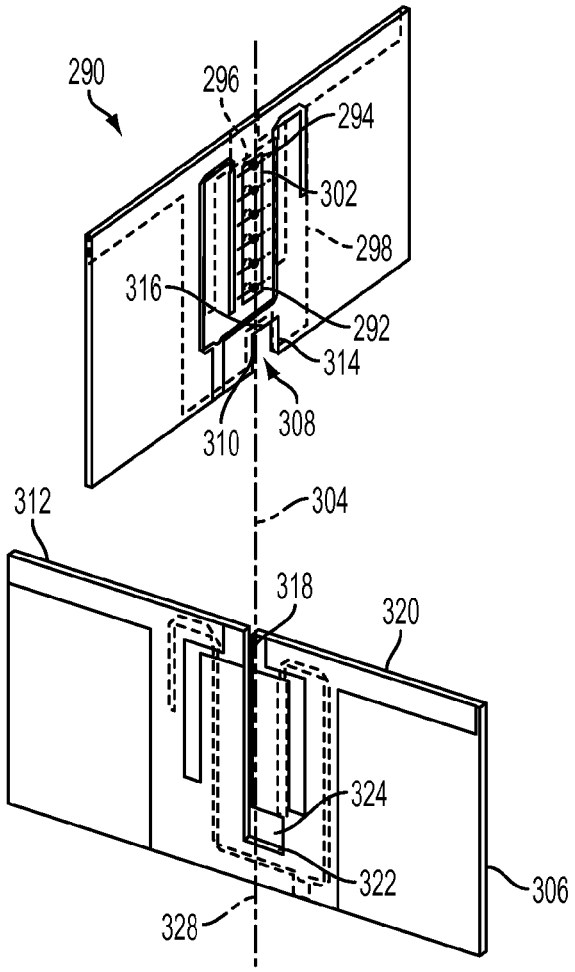
FIGS. 18A-B are microstrip double balun dipoles in a coincident phase center configuration according to the invention.
Figure 18B:
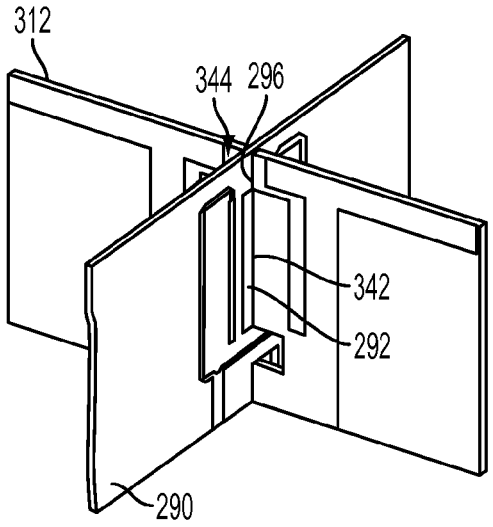

The procedure for arranging microstrip double balun dipoles in a coincident phase center configuration is detailed in FIGS. 18A and 18B. Referring to FIG. 18A, a first microstrip double Marchand balun dipole 290 has a conducting tab 292 added in the region where a second dipole will interleave with it. The tab is made as large as possible while maintaining sufficient distance from balun circuitry so as not to interfere with its performance. In particular, the top edge of the tab 294 is made flush with the bottom edge of the E-plane tee 296 (hidden) on the far side. Several vias 298 between the tab and the dipole conductor are made in the dielectric and plated with conducting material so as to make electrical contact between the tab and the dipole conductor 300 (hidden). The topmost via 302 is made as close to top edge 294 as fabrication technology will allow. The center line of the vias 304 is contiguous with the center of dielectric layer 306 of the second dipole. A notch 308 is cut in the bottom edge of element 290. The back edge of the slot 310 is positioned so as to provide mechanical clearance for the second dipole circuit board 312. The front edge 314 and top edge 316 of the slot are positioned so to provide electrical clearance for the feed line on the second dipole when it is joined with the first.

A second microstrip double Marchand balun dipole 312 has a downward protruding slot 318, cut from top edge 320 to a point 322 corresponding to the top edge of slot 316 in the first dipole. The width of slot 318 is just sufficient to provide clearance for the first dipole 290. At the bottom of slot 318, there is an enlargement 324 which provides electrical clearance for feed line 326 on the first dipole. The center of the dielectric layer 306 lines up with the center line 304 of the vias on the first dipole. This may be slightly offset from overall center of element 328.

FIG. 18B shows the assembly 340 of dipoles 290 and 312 into a coincident phase center unit cell. The seam 342 between tab 292 and the dipole conductor of dipole 312 is soldered as is the seam 344 between the dipole conductor of element 290 and element 312. In both cases special attention is required to make the solder connection extend as close to E-plane tee 296 as possible.

It should be noted that the stripline double Marchand balun dipole has both physical and electrical symmetry while the microstrip double Marchand balun has only electrical symmetry. Furthermore, the coincident phase center configuration increases the asymmetry of the microstrip dipole. Numerical simulations have shown that the stripline coincident phase center dipole configuration may have polarization purity in the range of 50 to 60 dB while the microstrip coincident phase center dipole may have polarization purity of 30 to 40 dB.

However, for a given dielectric thickness and transmission line impedance wider circuit traces are used with microstrip than with stripline. All the figures presented so for designs that were designed for a two inch cell size which corresponds to a low frequency regime beginning at 3 GHz. If the designs were scaled to 18 GHz, they would be unrealizable in stripline. The thickness of the dipoles would scale down to about 10 mils. Using a low dielectric constant dielectric, Duroid for example, the feed lines of the balun circuit would be about 1.5 mils wide in stripline and about 8 mils wide with microstrip.

Isolated Element

In simulations of an isolated element, the low frequency response disappears, but the dipole remains well matched in the high frequency regime. Numerous simulations have failed to find any combination of stub dimensions which produce a good match in the low frequency regime. However, combinations of open circuit 94 and 96, and short circuit, 102 and 104, stub lengths are easy to find which produce a good match in the high frequency regime. Ultimately the radiation characteristics degrade, limiting the high frequency regime. At the boundary between the low and high frequency regimes, the dipole is a quarter wavelength from the ground plane behind it, which is the optimum condition. At twice that frequency the dipole is one half wavelength above the ground plane behind it which produces a radiation pattern null on axis.

Construction Details

Figure 19:
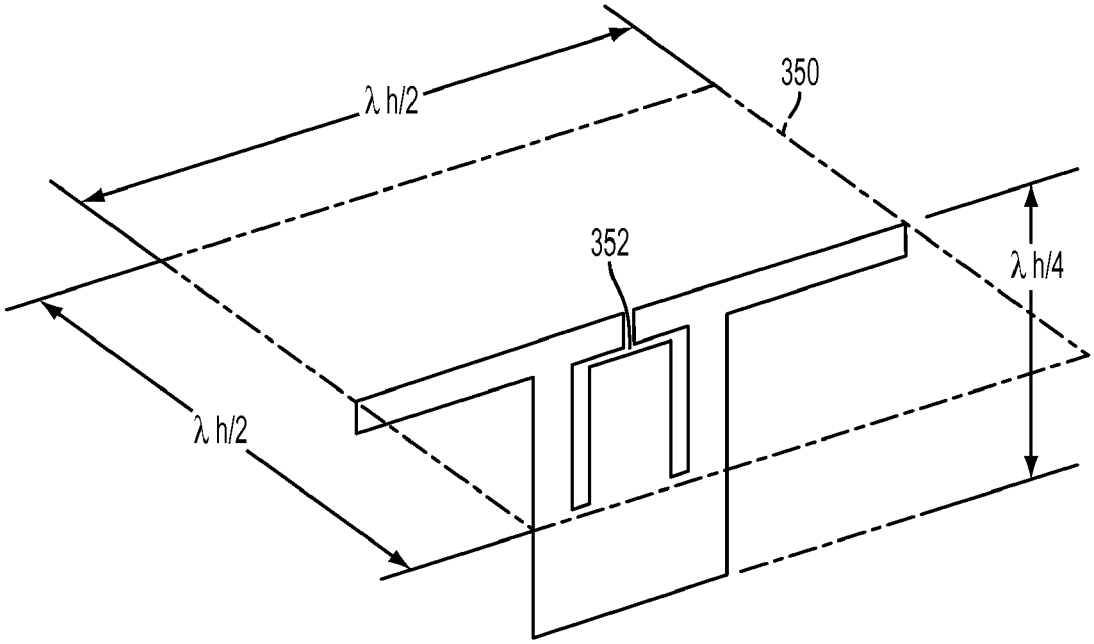
FIG. 19 shows construction details of a double Marchand balun dipole in an array environment according to the invention.

FIG. 19 shows construction details of double Marchand balun dipole in an array environment. Previously mention was made of the high and low frequency regimes. The division between the two is the frequency at which unit cell size 350 is a half wavelength. Designate that frequency $f_h$ and the corresponding length $\lambda_h/2$. All of the dipoles presented to this point had a height $\lambda_h/4$.

Generally the low frequency regime is useful for electronic beam steering. Maintaining a perfectly square lattice is only necessary for coincident phase center applications. The most important detail to observe is maintaining electrical continuity across the E-plane tee 352.

Bandwidth Enhancement

The upper frequency useful for electronic beam steering is flexible. The smaller the range of scan angles, the higher the cutoff frequency. The frequency $f_G$ at which grating lobes begin to from is given by $$f_G = \frac{c}{d(1+\cos(\theta))}$$

where c is the speed of light, d is the element spacing, and θ is the angle of scanning from broadside. Using $f_G$ as upper limit for scanning can increase scanning bandwidth.

As noted in reference to FIG. 11, bringing the tips of adjacent dipoles closer together improves the low frequency response. In general this causes an increase in reflection at higher frequencies.

Increasing the height of the dipoles also improves the low frequency response. In general this also causes an increase in reflection at higher frequencies.

Hence extending the bandwidth at the low end results in a compromise.

Figure 5:
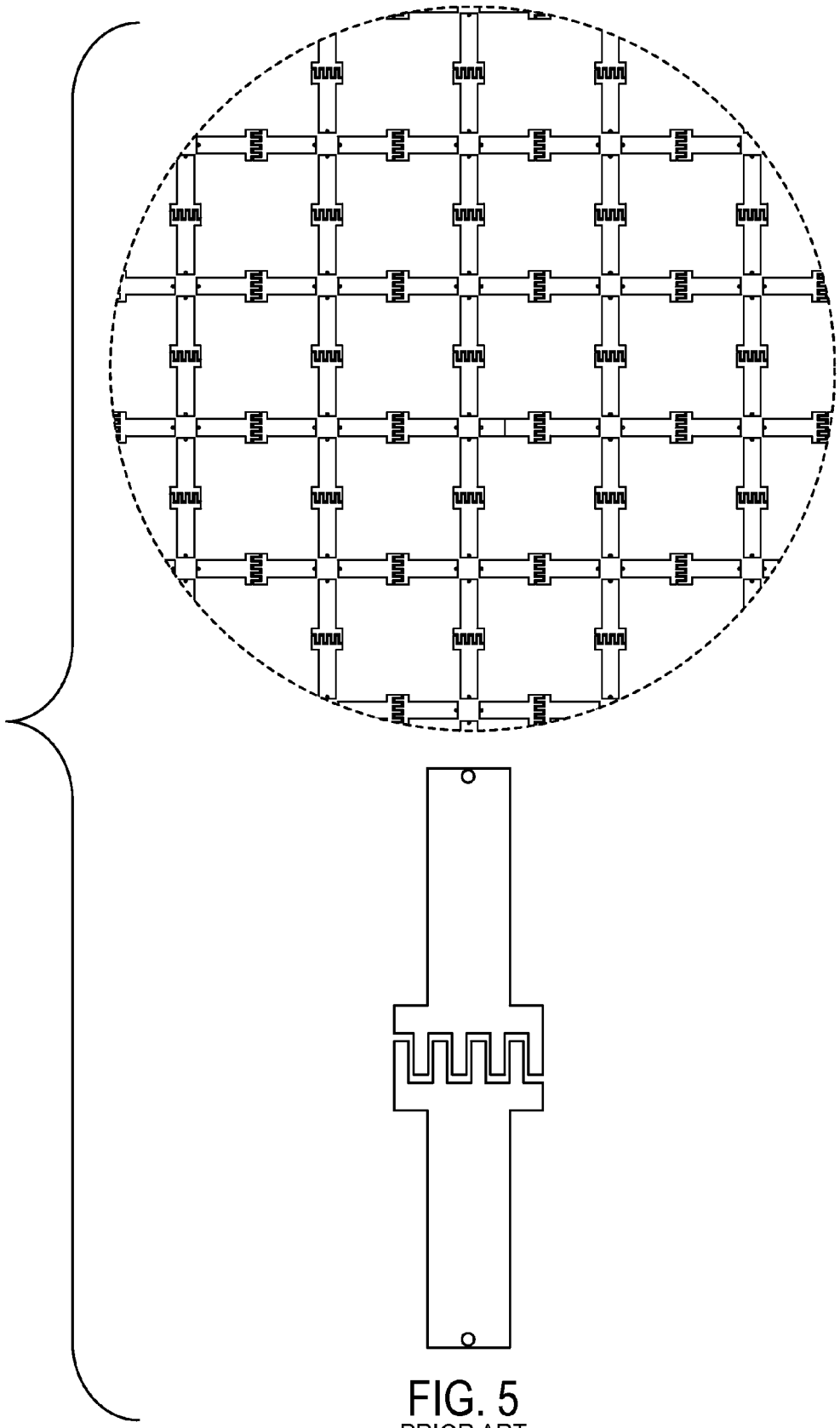
FIG. 5 PRIOR ART
FIG. 5 illustrates array antenna configurations.
Figure 6:
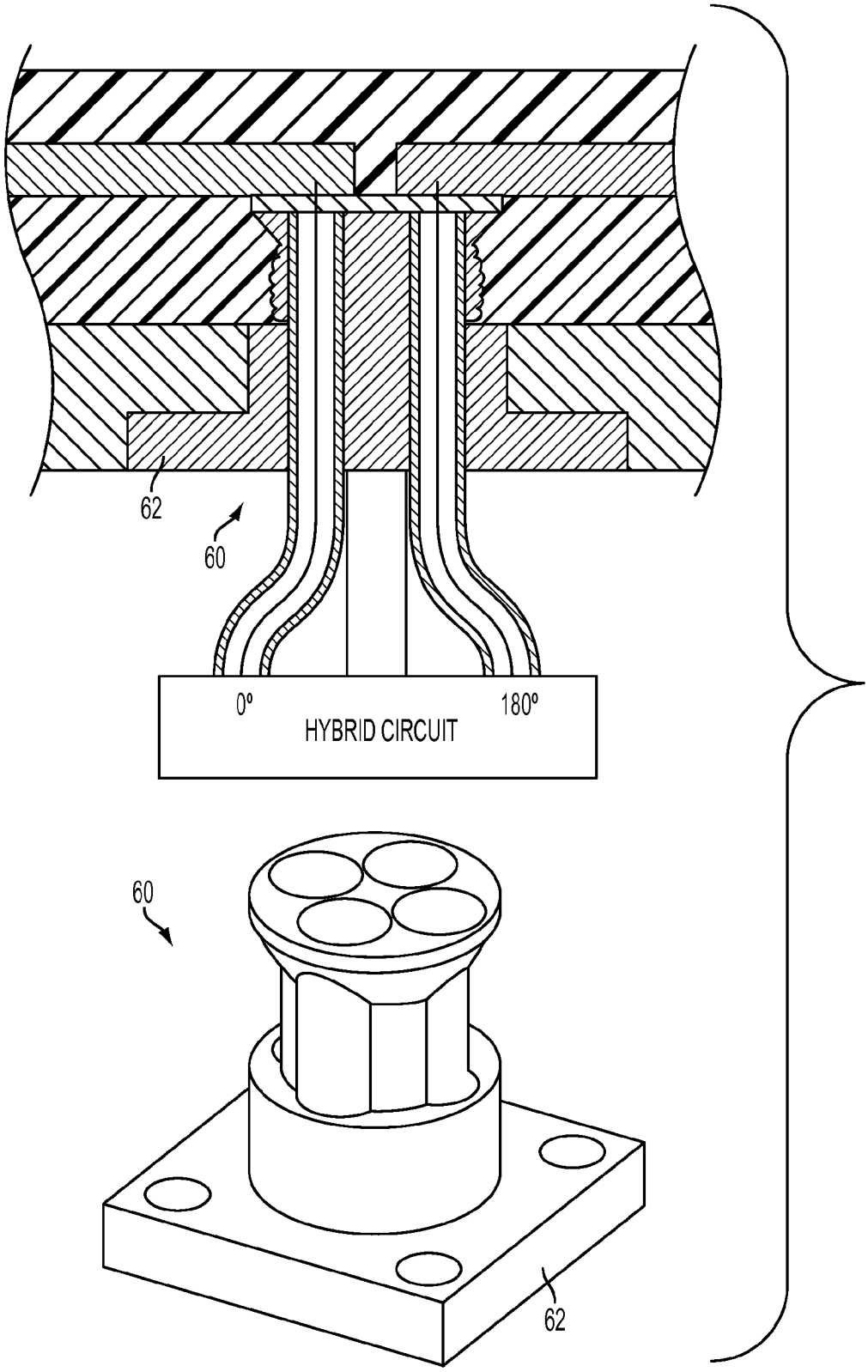
FIG. 6 PRIOR ART
FIG. 6 illustrates a feed network and associated feed line organizer.
Figure 20B:
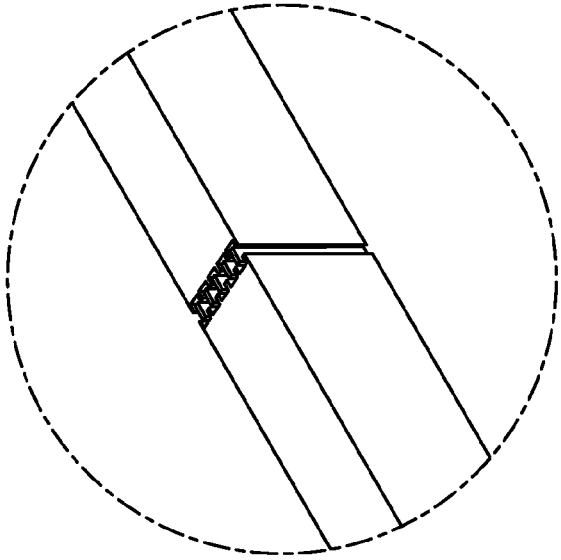
FIG. 20 illustrates the use of end capacitors in an array according to the invention.
Figure 20A:
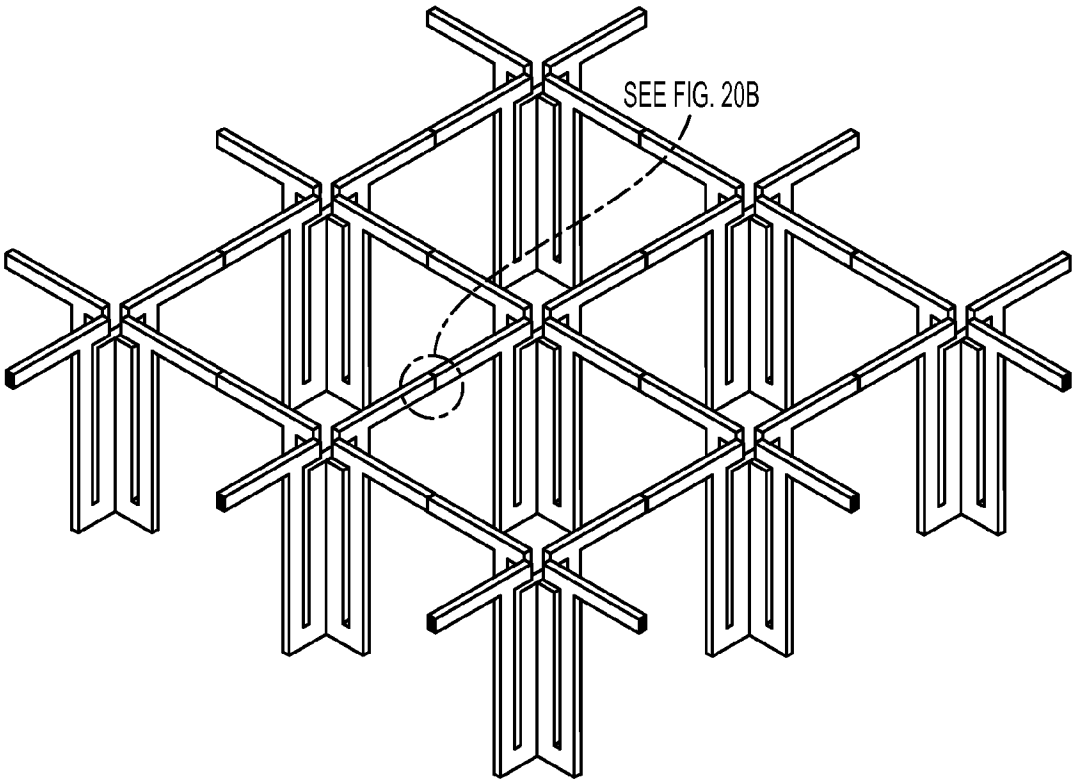
Figure 21:
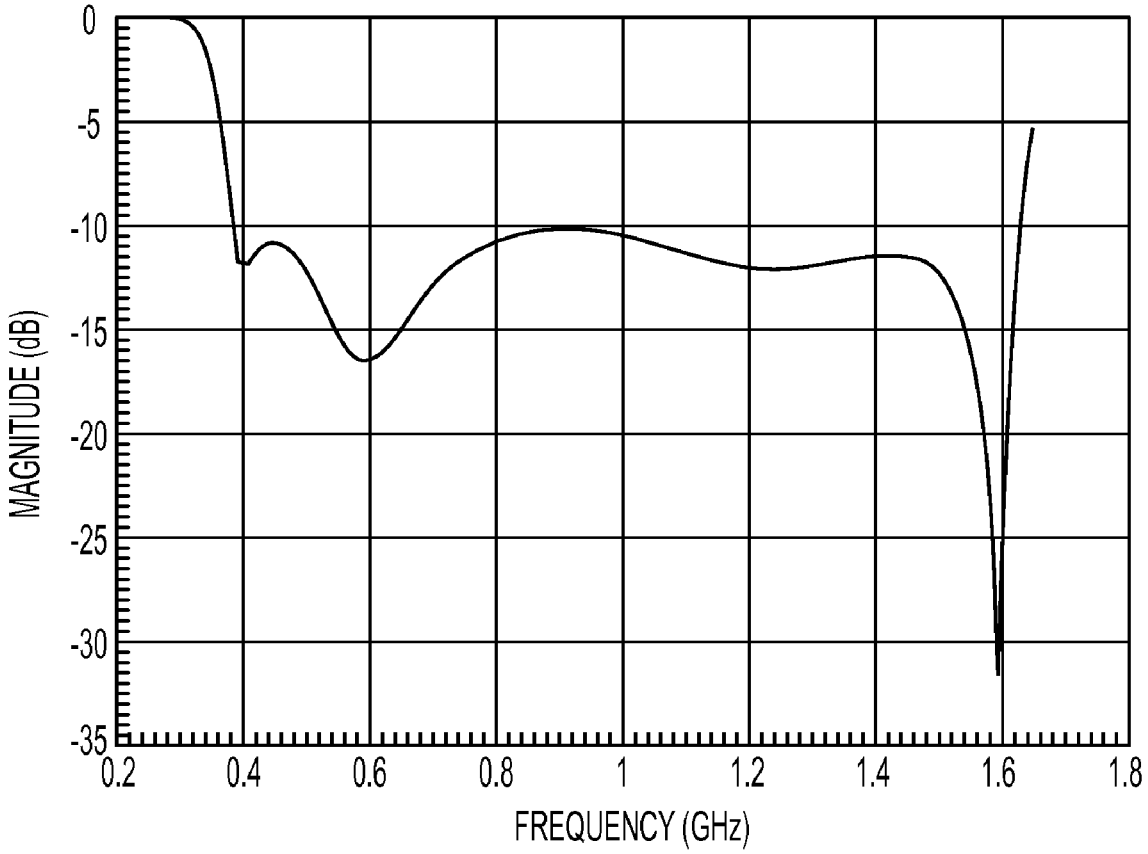
FIG. 21 shows simulation results of the array of FIG. 20.

Simulations (see FIG. 21) show that the double Marchand balun is capable of operating over a 4:1 bandwidth if end capacitors similar to those used by Munk in FIG. 5 are employed and if the height of the dipoles is increased to $3\lambda_h/8$. This is shown in FIG. 20 for a double balun dipole array with a 4200 mil cell size. The distinction with Munk's design is the that the double Marchand balun dipole has the balun integrated with the dipole so that unbalanced transmission line modes are presented at the ports of the dipole. Munk's dipoles present balanced transmission line modes at their ports, and this causes a practical difficulties already noted.

Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. A double balun dipole antenna element, comprising:

a dielectric substrate having a first surface and an opposing second surface;

a pair of coplanar Marchand baluns positioned in a mutually antiphase configuration on the first and second surfaces; and at least one feed line connected to the pair of Marchand baluns.

2. An antenna element as in claim 1, wherein each Marchand balun comprises:

a short circuited slotline stub on the first surface and wherein the first surface includes a conducting layer adjacent to each short circuit stub; and an open circuited conductor stub positioned on the second surface and wherein the second surface also comprises the dielectric substrate.

3. An antenna element as in claim 2, wherein the substrate has a leading edge and a trailing edge, the feed line includes a feed port positioned at the trailing edge, and the short circuited slotline stubs are mutually parallel and form an inverted U shape connected by an open-circuited slot terminating at the leading edge.

4. An antenna element as in claim 3, wherein each short circuited slotline stub is the same electrical length and one is bent at about a 90 degree angle so as to fit both short circuited slotline stubs completely within a perimeter of the first surface.

5. An antenna element as in claim 1, wherein each Marchand balun has a separate feed line.

6. A doubly polarized antenna element, comprising a pair of orthogonally interleaved double balun dipole antenna elements, wherein each antenna element comprises:

a dielectric substrate having a first surface and an opposing second surface;

a pair of coplanar Marchand baluns positioned in a mutually antiphase configuration on the first and second surfaces; and at least one feed line connected to the pair of Marchand baluns.

7. An antenna element as in claim 6, wherein each Marchand balun of each antenna element comprises:

a short circuited slotline stub on the first surface and wherein the first surface includes a conducting layer adjacent to each short circuit stub; and an open circuited conductor stub positioned on the second surface and wherein the second surface also comprises the dielectric substrate.

8. An antenna element as in claim 7, wherein the substrate has a leading edge and a trailing edge, the feed line includes a feed port positioned at the trailing edge, and the short circuited slotline stubs are mutually parallel and form an inverted U shape connected by an open-circuited slot terminating at the leading edge.

9. An antenna element as in claim 8, wherein each short circuited slotline stub is the same electrical length and one is bent at about a 90 degree angle so as to fit both short circuited slotline stubs completely within a perimeter of the first surface.

10. An antenna element as in claim 6, wherein each Marchand balun has a separate feed line.

11. An antenna array, comprising: a plurality of pairs of orthogonally interleaved double balun dipole antenna elements, wherein each antenna element comprises:

a dielectric substrate having a first surface and an opposing second surface;

a pair of coplanar Marchand baluns positioned in a mutually antiphase configuration on the first and second surfaces; and at least one feed line connected to the pair of Marchand baluns.

12. An antenna array as in claim 11, wherein each Marchand balun of each antenna element comprises:

a short circuited slotline stub on the first surface and wherein the first surface includes a conducting layer adjacent to each short circuit stub; and an open circuited conductor stub positioned on the second surface and wherein the second surface also comprises the dielectric substrate.

13. An antenna element as in claim 12, wherein the substrate has a leading edge and a trailing edge, the feed line includes a feed port positioned at the trailing edge, and the short circuited slotline stubs are mutually parallel and form an inverted U shape connected by an open-circuited slot terminating at the leading edge.

14. An antenna array as in claim 13, wherein each short circuited slotline stub is the same electrical length and one is bent at about a 90 degree angle so as to fit both short circuited slotline stubs completely within a perimeter of the first surface.

15. An antenna array as in claim 12, wherein the array comprises a plurality of rows of elements and each row further comprises a matching end tab at each end of each row.

16. An antenna array as in claim 11, wherein each March-and balun has a separate feed line.

* * * * *